US008011945B2

(12) United States Patent
Seong et al.

(10) Patent No.: US 8,011,945 B2
(45) Date of Patent: Sep. 6, 2011

(54) LOCKING DEVICE AND HIGH VOLTAGE SHIELD CONNECTOR HAVING THE SAME

(75) Inventors: Beob Mo Seong, Jeollabuk-do (KR); Seung Cho Han, Incheon (KR); Ja Kyeom Kim, Incheon (KR)

(73) Assignees: Hyundai Motor Company, Seoul (KR); Kyungshin Industrial Company, Incheon (KR)

( * ) Notice: Subject to any disclaimer, the term of this patent is extended or adjusted under 35 U.S.C. 154(b) by 0 days.

(21) Appl. No.: 12/764,585

(22) Filed: Apr. 21, 2010

(65) Prior Publication Data

US 2011/0104930 A1 May 5, 2011

(30) Foreign Application Priority Data

Nov. 5, 2009 (KR) ..... 10-2009-0106235

(51) Int. Cl.
*H01R 4/50* (2006.01)

(52) U.S. Cl. ..... 439/345

(58) Field of Classification Search ..... 439/345, 439/352

See application file for complete search history.

(56) References Cited

U.S. PATENT DOCUMENTS

| | | | | |
|---|---|---|---|---|
| 4,548,455 | A * | 10/1985 | Ezure | 439/152 |
| 4,832,615 | A | 5/1989 | Thakrar et al. | |
| 4,892,490 | A * | 1/1990 | Tsuchiya et al. | 439/533 |
| 4,938,710 | A * | 7/1990 | Aihara et al. | 439/345 |
| 4,940,423 | A * | 7/1990 | Aihara et al. | 439/369 |
| 5,511,993 | A | 4/1996 | Yamada et al. | |
| 5,791,930 | A * | 8/1998 | Tabata et al. | 439/345 |
| 6,361,349 | B1 * | 3/2002 | Hung | 439/357 |
| 6,561,832 | B2 * | 5/2003 | Geltsch et al. | 439/345 |
| D564,968 | S | 3/2008 | Sakamoto | |
| 7,601,019 | B2 * | 10/2009 | Hsieh et al. | 439/345 |
| 2008/0318460 | A1 * | 12/2008 | Hsieh et al. | 439/345 |
| 2009/0291584 | A1 * | 11/2009 | Wu | 439/345 |

FOREIGN PATENT DOCUMENTS

| | | | |
|---|---|---|---|
| JP | 2001-060481 | A | 3/2001 |
| JP | 2003-187922 | A | 7/2003 |
| KR | 10-2002-0073262 | | 9/2002 |
| KR | 10-2008-0036800 | | 4/2008 |
| KR | 10-2009-0047167 | A | 5/2009 |

* cited by examiner

*Primary Examiner* — T C Patel
*Assistant Examiner* — Vladimir Imas
(74) *Attorney, Agent, or Firm* — Edwards Angell Palmer & Dodge LLP; Peter F. Corless

(57) ABSTRACT

The present invention provides a locking device and a high voltage shield connector having the same. The locking device of the present invention preferably includes a mounting hole configured to penetrate the circumferential surface of a female housing, a support member configured to be supported on an edge of the mounting hole, a restraining member extending to a lower portion of the support member and projecting to the inside of the female housing, and a locker formed on a male housing to restrain the restraining member to be connected to the female housing.

17 Claims, 9 Drawing Sheets

LOCKING DEVICE AND HIGH VOLTAGE SHIELD CONNECTOR HAVING THE SAME

CROSS-REFERENCE TO RELATED APPLICATION

This application claims under 35 U.S.C. §119(a) the benefit of Korean Patent Application No. 10-2009-0106235 filed Nov. 5, 2009, the entire contents of which are incorporated herein by reference.

BACKGROUND (a) Technical Field

The present disclosure relates, generally, to a high voltage shield connector. More particularly, the present invention relates to a locking device and a high voltage shield connector having the same which can prevent accidental disconnection of connected male and female housings of a high voltage shield connector, thus suitably reducing connection failure of the connector.

(b) Background Art

Due to electronization of vehicles in recent years, a lot of electronic components or sensors are used. Electrical signals are simultaneously produced by the electronic components or sensors. The thus produced electrical signals are transmitted to a control device or drive device through a plurality of signal lines. In this procedure, electromagnetic waves may be generated irregularly due to the electrical signals. When these electromagnetic waves are transmitted directly or indirectly to the signal lines or electronic devices, the electronic devices may malfunction, which would be dangerous to a driver.

Accordingly, to prevent the above problem, a shield cable is typically used in a harness of a vehicle. The shield cable preferably includes a central line made of a conductor, an inner coating suitably configured to surround the central line, a shield layer suitably configured to surround the outside of the inner coating with braided wires, and an outer sheath suitably formed on the outside of the shield layer. Here, preferably the shield layer made of a conductive material absorbs noise generated from the outside to prevent the noise from penetrating into the central line that transmits signals.

Further, when the shield cable is connected to an electronic device or another type of cable using a connector without a separate shielding member, the noise generated from the outside may have an influence on the contact point. Accordingly, when the shield cable is suitably connected to an electronic device or another type of cable, a shield connector suitably configured to prevent external noise from penetrating into the contact point is preferably used.

That is, since the existing shield connectors are suitably configured to connect male and female housings in a hook-like manner, the shield connectors may be loose due to frequent disconnection and connection, which may cause connection failure. Accordingly, there is a need in the art for shield connectors that reduce connection failure.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention preferably provides a locking device and a high voltage shield connector having the same, in which a restraining member capable of being lifted up and down in a normal direction is preferably provided on a female housing and a locker is preferably provided in a male housing so as to suitably maintain the connection between the male and female housings even when the connector is frequently assembled and disassembled.

In preferred embodiments, the present invention provides a locking device and a high voltage shield connector having the same, in which a damping member having a coil spring shape is preferably provided between a fixing member fixing a female housing and the female housing so as to suitably improve damping force when an external force in the axial direction is suitably generated.

In one aspect, the present invention provides a locking device preferably including: a mounting hole suitably configured to penetrate a fixed structure; a support member suitably configured to be supported on an edge of the mounting hole; a restraining member suitably extending to a lower portion of the support member and projecting to the inside of the fixed structure; and a locker suitably restraining the restraining member and connected to the fixed structure.

In a preferred embodiment, the locker may preferably include: a body being in contact with an edge of the fixed structure; a lower support rib suitably extending from the body and elastically supporting a lower portion of the restraining member; and an upper support rib suitably extending from the body to be spaced apart from the lower support rib by the thickness of the restraining member, elastically supporting an upper portion of the restraining member, and elastically supporting a side of the support member.

In another preferred embodiment, the lower support rib may preferably include a lower locking projection suitably formed to project toward the upper support rib to prevent accidental disconnection in a direction opposite to the insertion direction into the fixed structure.

In still another preferred embodiment, the upper support rib may preferably include an upper locking projection locked by the support member to suitably prevent accidental disconnection in a direction opposite to the insertion direction into the fixed structure.

In yet another preferred embodiment, the mounting hole may be suitably opened and closed by a cover, which is slidably guided on the circumferential surface of the fixed structure, to suitably prevent the support member from being separated outward from the mounting hole.

In still yet another preferred embodiment, a cushion member may be suitably interposed between the lower support rib and the cover such that the restraining member is suitably maintained in contact with the lower support rib.

In a further preferred embodiment, the fixed structure may preferably include a guide groove and the cover may preferably include a guide projection which is suitably accommodated in the guide groove.

In another further preferred embodiment, the cover may preferably include an insertion projection and the fixed structure may preferably include an insertion hole which suitably accommodates the insertion projection in a state where the mounting hole is completely closed.

In another aspect, the present invention preferably provides a high voltage shield connector including: a male housing; a female housing suitably configured such that a portion of the male housing is axially inserted into the front thereof; a fixing member partially axially inserted into the rear of the female housing and supporting the connection of the female housing; a damping member suitably interposed between the female housing and the fixing member to absorb an impact applied to the female housing; and a locking device for suitably connecting the male housing and the female housing.

In a preferred embodiment, the fixing member may preferably include: a plate member configured to be in contact with the female housing; and a sleeve member suitably extending from the plate member and axially inserted into the female housing, wherein the damping member having a coil spring shape may be suitably provided on the circumferential surface of the sleeve member such that both ends of the damping member are supported to the female housing and the plate member.

In another preferred embodiment, the locking device may preferably include: a mounting hole suitably configured to penetrate the circumferential surface of the female housing; a support member suitably configured to be supported on an edge of the mounting hole; a restraining member suitably extending to a lower portion of the support member and projecting to the inside of the female housing; and a locker formed on the male housing to suitably restrain the restraining member to be connected to the female housing.

In still another preferred embodiment, the locker may preferably include: a body suitably configured to project from the circumferential surface of the male housing and to be in contact with an edge of the female housing; a lower support rib suitably extending from the body and elastically supporting a lower portion of the restraining member; and an upper support rib suitably extending from the body to be spaced apart from the lower support rib by the thickness of the restraining member, elastically supporting an upper portion of the restraining member, and elastically supporting a side of the support member.

In yet another preferred embodiment, the mounting hole may preferably be opened and closed by a cover, which is slidably guided on the circumferential surface of the female housing, to suitably prevent the support member from being separated outward from the mounting hole, and the cover may preferably include a cushion member at the bottom thereof such that the restraining member is suitably maintained in contact with the lower support rib.

In still yet another preferred embodiment, the male housing may preferably include guide ribs configured to face each other and to project from the circumferential surface of the male housing in the axial direction, the guide ribs may include locking grooves concavely formed in the inside of the guide ribs facing each other, and the lower support ribs may preferably include locking projections elastically accommodated in the corresponding locking grooves.

In another further preferred embodiment, the body may preferably include a position fixing groove and the male housing may preferably include a position fixing projection formed in the axial direction to be suitably accommodated in the position fixing groove.

Other aspects and preferred embodiments of the invention are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
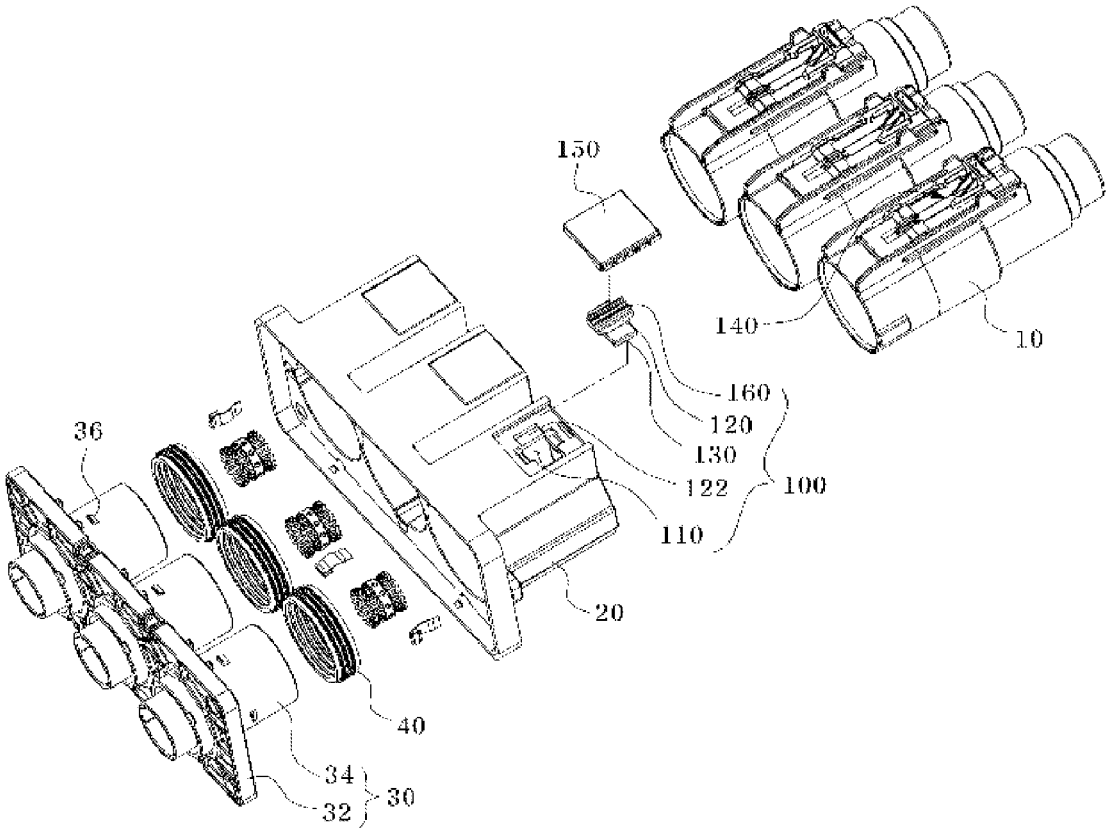
FIG. 1 is an exemplary exploded perspective view of a high voltage shield connector preferably including a locking device in accordance with an exemplary embodiment of the present invention.

Reference numerals set forth in the Drawings includes reference to the following elements as further discussed below:

| | |
|---|---|
| 10: male housing | 20: female housing |
| 30: fixing member | 40: damping member |
| 100: locking device | 110: mounting hole |
| 120: support member | 130: restraining member |
| 140: locker | 141: body |
| 143: lower support rib | 144: lower locking projection |
| 145: upper support rib | 146: upper locking projection |
| 150: cover | 160: cushion member |

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

As described herein, the present invention features a locking device comprising a mounting hole, a support member, a restraining member, and, a locker.

In one preferred embodiment, the mounting hole is configured to penetrate a fixed structure.

In another preferred embodiment, the support member is configured to be supported on an edge of the mounting hole.

In still another preferred embodiment, the support member extends to a lower portion of the support member and projects to the inside of a fixed structure.

In another further preferred embodiment, the locker restrains the restraining member and is connected to the fixed structure.

In another aspect, the present invention features a high voltage shield connector comprising a male housing, a female housing configured such that a portion of the male housing is axially inserted into the front thereof, a fixing member, a damping member; and, a locking device for connecting the male housing and the female housing.

In one preferred embodiment, the fixing member is partially axially inserted into the rear of the female housing and supports the connection of the female housing.

In another preferred embodiment, the damping member is interposed between the female housing and the fixing member to absorb an impact applied to the female housing.

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

Figure 2:
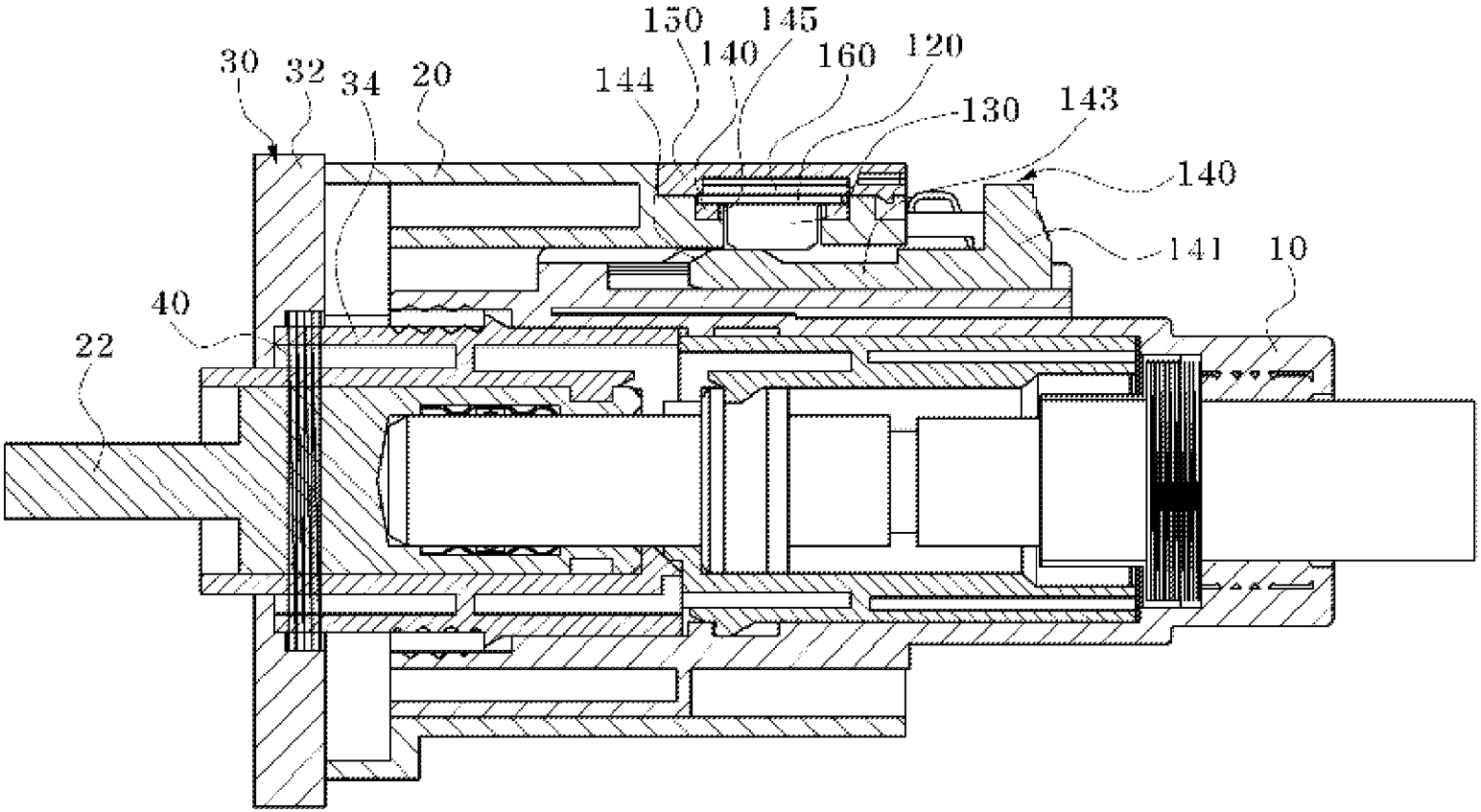
FIG. 2 is an exemplary cross-sectional view of the high voltage shield connector preferably including the locking device in accordance with an exemplary embodiment of the present invention.
Figure 3:
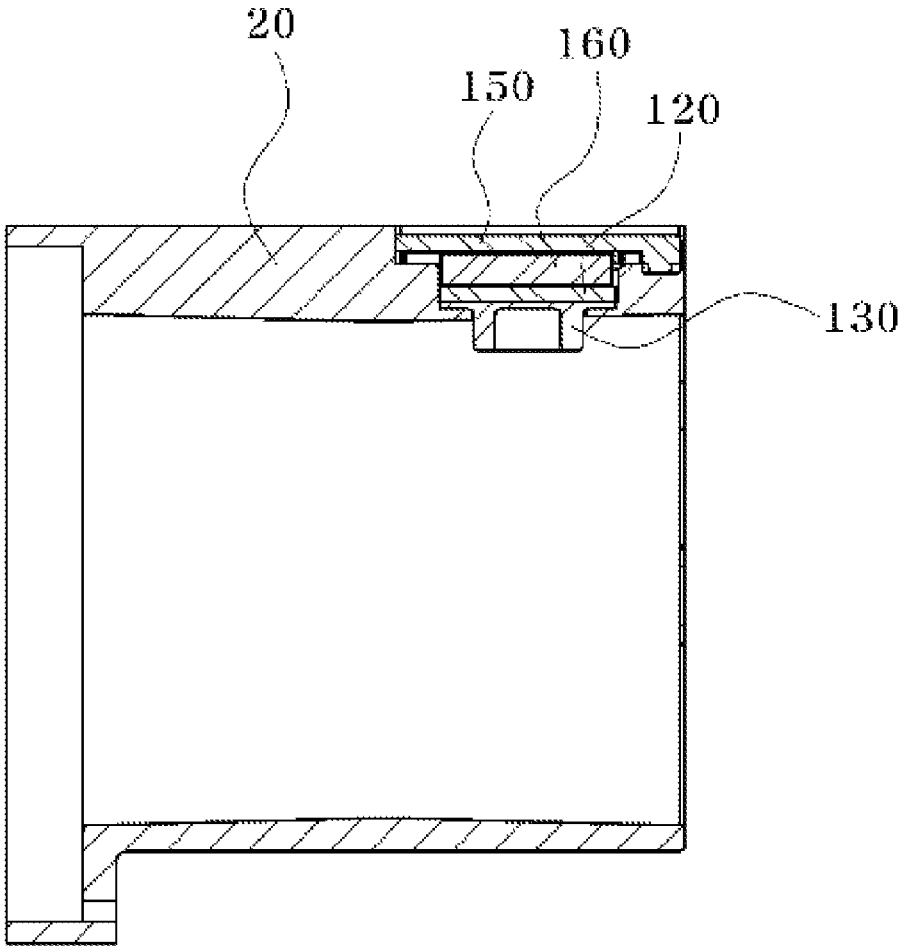
FIG. 3 is an exemplary enlarged cross-sectional view of a female housing of the high voltage shield connector preferably including the locking device in accordance with an exemplary embodiment of the present invention.

In certain exemplary embodiments of the present invention, referring for example to FIGS. 1 to 3, a high voltage shield connector preferably includes a male housing 10, a female housing 20, and a locking device 100.

Preferably, the male housing 10 serves to suitably accommodate a male terminal (not shown) and, therefore, both ends of the male housing 10 are opened.

In further preferred embodiments, the male housing 10 may preferably have various shapes and may be formed of various materials.

Preferably, the female housing 20 serves to suitably accommodate a female terminal 22 and, therefore, both ends of the female housing 20 are opened.

Preferably, the female housing 20 may have various shapes and may be formed of various materials.

According to certain preferred embodiments of the present invention, the female housing 20 is suitably configured such that a portion of the male housing 10 is axially inserted into the front side thereof. Accordingly, the male housing 10 is firmly fixed to the female housing 20 such that the connection state between the female terminal 22 and the male terminal is suitably maintained.

According to certain preferred embodiments, a single female housing 20 may be suitably configured to connect a single male housing 10, and a single female housing 20 may be suitably configured to connect a plurality of male housing 10.

Preferably, in further exemplary embodiments, the female housing 20 to which the male housing 10 is being connected may be suitably fixed to an external structure (not shown) such as a vehicle frame.

Accordingly, the female housing 20 is detachably connected to a fixing member 30 detachably connected to the external structure.

According to further preferred embodiments, the fixing member 30 fixed to the external structure may be suitably closely connected to the female housing 20 so as to suitably prevent the female housing 20 from being shaken.

Therefore, preferably, the fixing member 30 includes a plate member 32 and a sleeve member 34.

According to further preferred embodiments of the present invention, the plate member 32 is suitably connected to the external structure by bolting and comes in contact with the rear edge of the female housing 20 to suitably support the female housing 20.

Preferably, the plate member 32 may have various shapes and may be suitably formed of various materials.

Preferably, the sleeve member 34 extends from one side of the plate member 32 and is axially inserted into the female housing 20.

Accordingly, the sleeve member 34 is in suitable contact with the inside of the female housing 20 to firmly support the female housing 20.

Accordingly, although the sleeve member 34 may be suitably configured to be detached from the plate member 32, it is preferable that it is integrally molded with the plate member 32. Of course, the sleeve member 34 may have various shapes.

Preferably, the female terminal 22 may be suitably inserted into the inside of the sleeve member 34.

In further preferred embodiments, the female terminal 22 is suitably inserted into the inside of the sleeve member 34, the sleeve member 34 is suitably inserted into the inside of the female housing 20, and thereby the female terminal 22 is in suitable contact with the male terminal.

According to other further embodiments, although the female housing 20 is suitably detachably connected to the fixing member 30, it may be pushed toward the fixing member 30 when an external force is suitably applied thereto, and thereby it may be damaged.

Therefore, in other further embodiments, a damping member 40 may be suitably provided between the female housing 20 and the fixing member 30.

Preferably, the damping member 40 may be suitably interposed between the rear edge of the female housing 20 and the plate member 32.

In an exemplary embodiment, the damping member 40 preferably has a coil spring shape and is suitably provided on the circumferential surface of the sleeve member 34 such that both ends of the damping member 40 are suitably supported to the rear edge of the female housing 20 and the plate member 32.

Accordingly, since the damping member 40 is a coil spring, it can suitably serve as a damper between the plate member 32 and the female housing 20 over the entire circumference of the sleeve member 34.

Preferably, it is desired to prevent the damping member 40 from being separated in the axial direction of the sleeve member 34.

Accordingly, the sleeve member 34 preferably includes a locking projection 36 projecting from the circumferential surface thereof.

That is, in certain preferred embodiments, one side of the damping member 40 supports the entire plate member 32 and the other side thereof supports the locking projection 36.

In particular preferred embodiments, the locking projection 3 has a minimum size such that as much as possible of the other side of the damping member 40 is in elastics contact with the rear edge of the female housing 20.

In other certain embodiments, the locking projection 36 may have various shapes. Further, although the locking projection 36 may be suitably configured to be detached from the sleeve member 34, it is preferable that it is integrally molded to the sleeve member 34.

According to other preferred embodiments of the present invention, the male and female housings 10 and 20 are preferably firmly locked to each other for supply of electricity between the male terminal and the female terminal 22.

Preferably, even when the male housing 10 is suitably locked to the female housing 20, the female housing 20 is suitably damped by the damping member 40, and thereby it is not easily damaged.

In particular preferred embodiments, the male housing 10 and the female housing 20, which are detachably connected to each other, are firmly and elastically connected by a locking device 100.

In certain exemplary embodiments, the locking device 100 preferably includes a mounting hole 110, a support member 120, a restraining member 130, a locker 140, and a cover 150.

Figure 4:
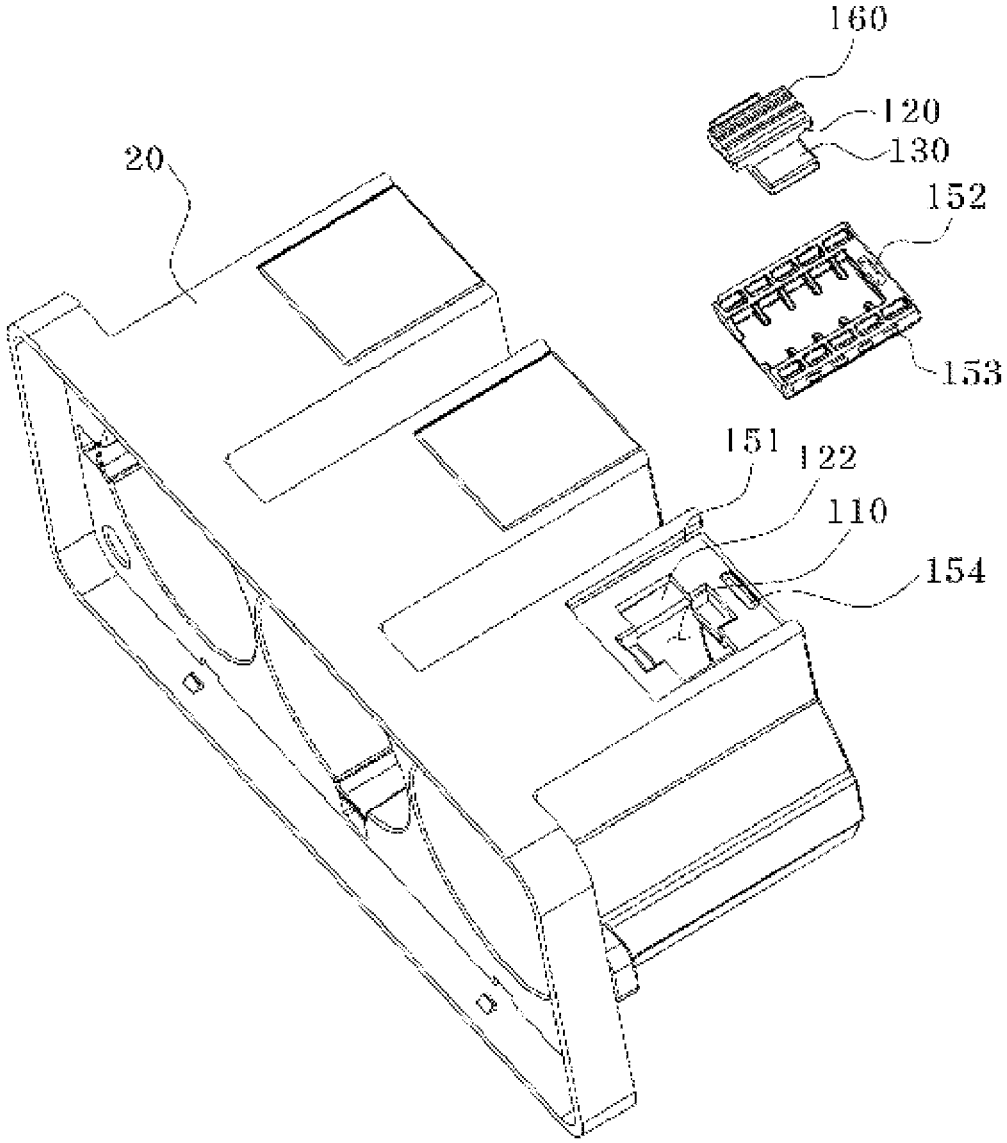
FIG. 4 is an exemplary enlarged view of the female housing of the high voltage shield connector preferably including the locking device in accordance with an exemplary embodiment of the present invention.
Figure 5:
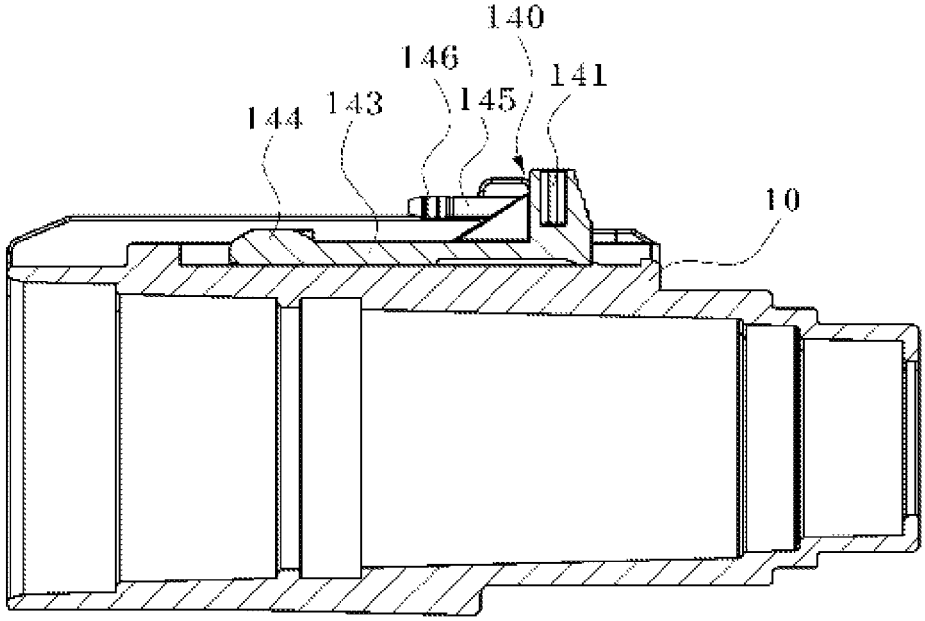
FIG. 5 is an exemplary enlarged cross-sectional view of a male housing of the high voltage shield connector preferably including a locking device in accordance with an exemplary embodiment of the present invention.

In certain preferred embodiments of the present invention, for example referring to FIGS. 4 and 5, the mounting hole 110 is suitably configured to penetrate a fixed structure, i.e., the female housing 20.

In further preferred embodiments, the mounting hole 110 is suitably perforated on the circumferential surface of the female housing 20 corresponding to the area where the male housing 10 is axially inserted. Accordingly, the male housing 10 is suitably exposed to the outside through the mounting hole 110.

Preferably, the mounting hole 110 may have various shapes.

In other certain preferred embodiments, the support member 120 is suitably to be supported on an edge of the mounting hole 110.

In further related embodiments, the female housing 20 preferably includes a supporting groove 122 concavely formed on both edges of the mounting hole 110, and the support member 120 is suitably accommodated on the supporting grooves 122 corresponding to both edges of the mounting hole 110.

Accordingly, as the support member 120 is suitably accommodated on the supporting grooves 122, the support member 120 is fixedly supported on the circumferential surface of the female housing 20.

Preferably, the support member 120 may have various shapes.

In other further preferred embodiments, the restraining member 130 suitably extends from the bottom of the support member 120 to the male housing 10 inserted into the inside of the female housing 20.

Accordingly, the restraining member 130 suitably projects to the inside of the fixed structure, i.e., the female housing 20.

Preferably, although the restraining member 130 may be suitably configured to be detached from the support member 120, it is preferable that it is integrally molded with the support member 120.

In certain preferred embodiments of the present invention, the restraining member 130 has a surface area greater than that of the support member 120 to be exposed to the outside of the support member 120 on the plane.

Preferably, the restraining member 130 may have various shapes.

In further preferred embodiments, the mounting hole 110 of the female housing 20 has a size to allow the restraining member 130 to be suitably inserted therethrough.

Accordingly, the locker 140 is suitably formed on the male housing 10. Preferably, the locker 140 is suitably formed on the circumferential surface of the male housing 10 to be suitably combined with the restraining member 130 in a state that the male housing 10 is suitably inserted into the inside of the female housing 20.

Accordingly, in further preferred embodiments, as the locker 140 suitably restrains the restraining member 130, the male housing 10 and the female housing 20 are suitably connected to each other.

Figure 6:
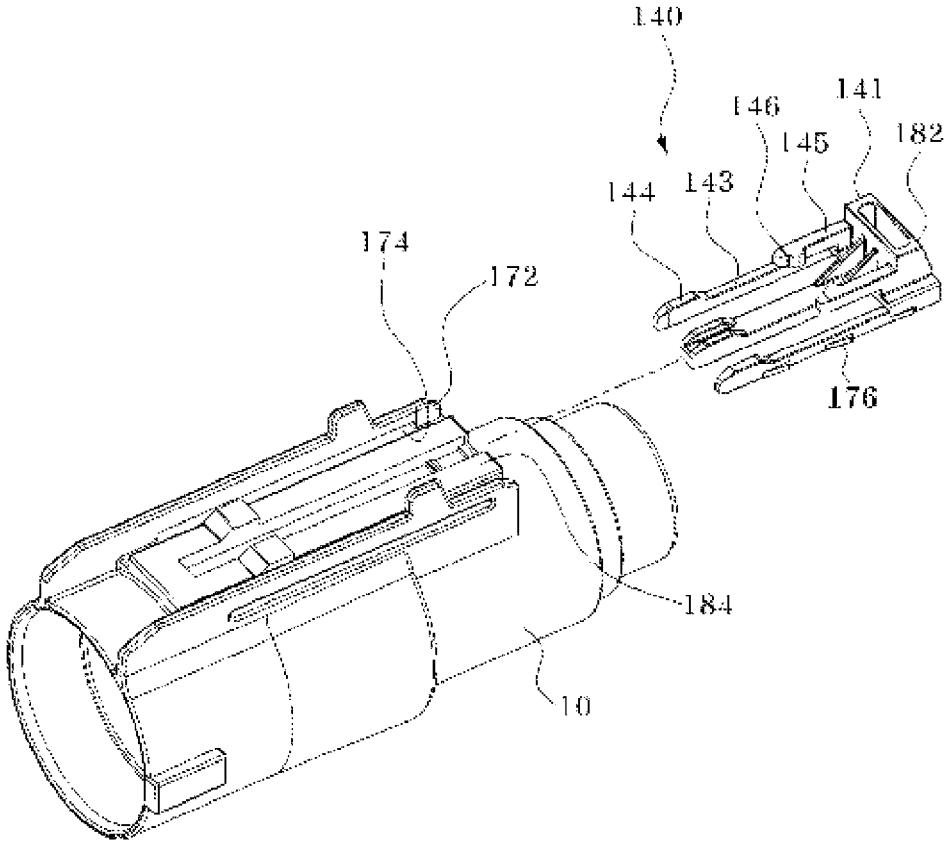
FIG. 6 is an exemplary enlarged view of the male housing of the high voltage shield connector preferably including the locking device in accordance with an exemplary embodiment of the present invention.
Figure 7:
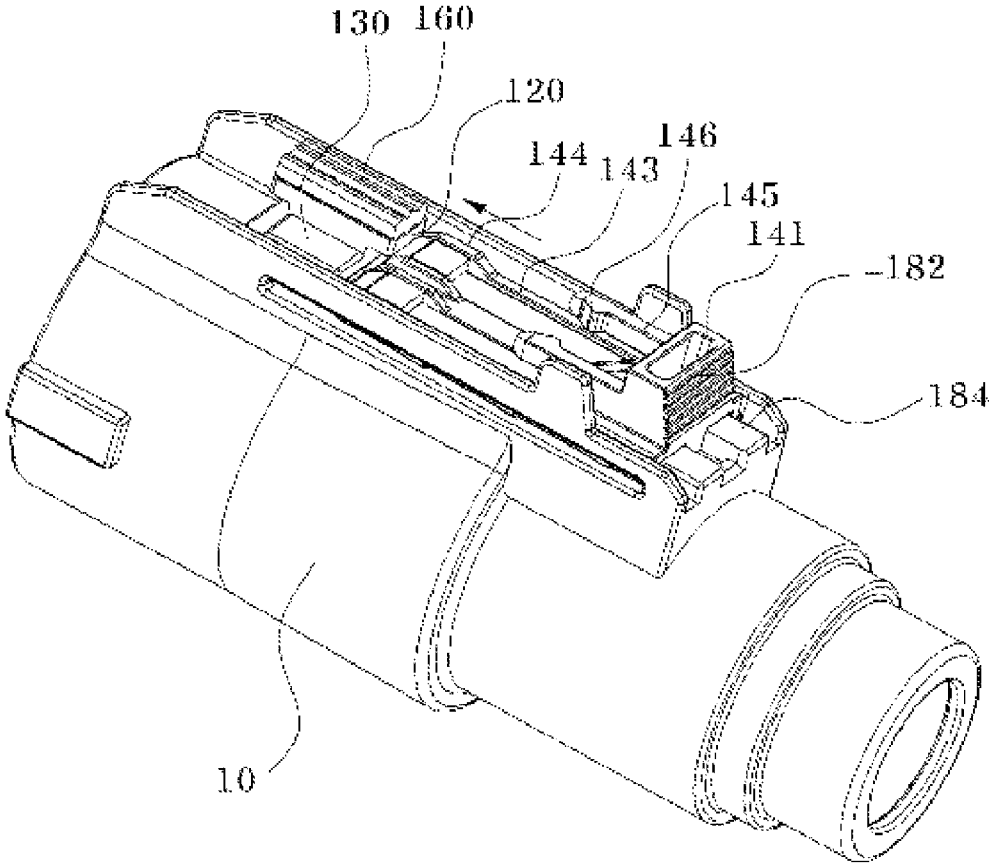
FIGS. 7 to 9 are exemplary perspective views showing the locking states of the high voltage shield connector preferably having the locking device in accordance with an exemplary embodiment of the present invention.

In another exemplary embodiment, for example as shown in FIGS. 6 and 7, the locker 140 preferably includes a body 141, a lower support rib 143, and an upper support rib 145.

According to further preferred embodiments, the body 141 projects from the circumferential surface of the male housing 10 and is in contact with the edge of the fixed structure, i.e., the female housing 20.

Accordingly, the body 141 serves to suitably limit the depth of penetration of the male housing 10 into the inside of the female housing 20.

In further preferred embodiments, the lower support rib 143 suitably extends from the body 141 to elastically support the bottom of the restraining member 130, and the upper support rib 145 suitably extends from the body 141 to elastically support the top of the restraining member 130.

Accordingly, the lower and upper support ribs 143 and 145 preferably extend from the body 141 in the same direction.

In further preferred embodiments of the present invention, the body 141 suitably maintains a constant distance between the lower and upper support ribs 143 and 145 with respect to the height direction. Preferably, the lower and upper support ribs 143 and 145 are suitably spaced apart about the same thickness as the restraining member 130.

Accordingly, as the restraining member 130 is suitably fixed between the lower and upper support ribs 143 and 145, they are suitably prevented from colliding with each other, thus suitably preventing generation of noise.

In further preferred embodiments of the present invention, the upper support rib 145 elastically supports the side of the support member 120.

Accordingly, the support member 120 and the restraining member 130 are suitably fixed by the locker 140 in the inside of the mounting hole 110 of the female housing 20.

Preferably, although the lower and upper support ribs 143 and 145 may be suitably configured to be detached from the body 141, it is preferable that they are suitably integrally molded with the body 141, and they may have various shapes.

In particular preferred embodiments of the present invention, the locker 140 may be suitably fixed in the inside of the female housing 20 by the restraining member 130.

Preferably, the lower support rib 143 includes a lower locking projection 144 suitably formed to project toward the upper support rib 145 to prevent accidental disconnection in a direction opposite to the insertion direction into the female housing 20.

Accordingly, in certain preferred embodiments, although the lower locking projection 144 may be suitably configured to be detached from the lower support rib 143, it is preferable that it is suitably integrally molded with the lower support rib 143, and it may have various shapes.

Accordingly, as the lower locking projection 144 is in suitable contact with the lower edge of the front of the restraining member 130, the locker 140 is suitably locked by the restraining member 130 and thus is not disconnected in the direction opposite to the insertion direction into the female housing 20.

Further, when the lower support rib 143 is preferably inserted into the inside of the female housing 20, the lower locking projection 144 suitably raises the restraining member 130 and the support member 120 to a predetermined height in the inside of the mounting hole 110.

Accordingly, the restraining member 130 and the support member 120 can be suitably lifted up and down in the mounting hole 110.

Further, when the lower locking projection 144 passes through the restraining member 130, the restraining member 130 goes down by the self weight and then is in contact with the lower support rib 143.

In other further embodiments, the upper support rib 145 may suitably restrain the locker 140 at the same time when the restraining member 130 suitably restrains the lower support rib 143.

According to preferred embodiments of the present invention, the reason for this is to firmly connect the male housing 10 to the inside of the female housing 20 by suitably fixing the locker 140 in the inside of the female housing 20.

Accordingly, an upper locking projection 146 is preferably formed on the upper support rib 145 to be suitably locked by the support member 120, thus preventing accidental disconnection in the direction opposite to the insertion direction into the female housing 20.

Preferably, a pair of upper support ribs 145 may be suitably formed in parallel on the body 141 so as to be in contact with both sides of the support member 120.

In further preferred embodiments, the upper locking projections 146 may be formed in the inside of the upper support ribs 145 facing each other.

Preferably, although the upper locking projections 146 may be suitably configured to be detached from the upper support rib 145, it is preferable that they are suitably integrally molded with the upper support rib 145, and they may have various shapes.

Accordingly, as the upper locking projections 146 are in suitable contact with both edges of the front of the support member 120, the locker 140 is suitably locked by the support member 120 and thus is not suitably disconnected in the direction opposite to the insertion direction into the female housing 20.

According to further preferred embodiments, when the pair of upper support ribs 145 suitably accommodates the support member 120, the upper support ribs 145 facing each other are elastically bent outwardly by the projection height of each of the upper locking projections 146.

In further preferred embodiments, when the upper locking projections 146 are in suitable contact with the front of the support member 120, the upper support ribs 145 are elastically restored and come in contact with the side of the support member 120.

Preferably, the support member 120 and the restraining member 130 may be suitably separated to the outside of the mounting hole 110.

Accordingly, the fixed structure, i.e., the female housing 20 preferably includes a cover 150. In related embodiments, the cover 150 preferably serves to open and close the mounting hole 110.

For example, in certain exemplary embodiments, the fixed structure, i.e., the female housing 20 may preferably include a guide groove 151, and the cover 150 may preferably include a guide projection 153.

Accordingly, as the guide projection 153 moves along the inside of the guide groove 151, the cover 150 opens and closes the mounting hole 110.

Preferably, the cover 150 may have various shapes and may be suitably formed of various materials.

In other further embodiments, the guide groove 151 may be suitably formed on the circumferential surface of the female housing 20 in various ways. Although the guide projection 153 may be configured to be detached from the cover 150, it is preferable that it is suitably integrally molded with the cover 150.

Although the guide groove 151 is shown as a groove shape for convenience's sake, it may have a hole shape.

In other preferred embodiments, the restraining member 130 may be suitably maintained in contact with the lower support rib 143 by the force applied downward.

In still other exemplary embodiments, it is possible to suitably maintain the state in which the restraining member 130 is in suitable contact with the top of the lower support rib 143 by bringing the cover 150 into contact with the top of the support member 120 at all times.

Preferably, the support member 120 and the restraining member 130 are not raised even when the force pushing the lower locking projection 144 upward is suitably applied, and thereby the restraining member 130 or the lower support rib 143 may be bent or damaged.

Accordingly, a gap space may be suitably formed between the support member 120 and the cover 150 such that the support member 120 is suitably lifted up and down.

Accordingly, a cushion member 160 may preferably be provided at the bottom of the cover 150.

In certain preferred embodiments, the cushion member 160 may be made of a material such as sponge which is suitably pressed by an external force and returned to its original state when the external force is removed.

Accordingly, when the lower locking projection 144 pushes the restraining member 130 upward, the support member 120 pushes the cushion member 160 upward.

Preferably, the cushion member 160 is suitably supported on the lower surface of the cover 150 and compressed.

In other certain embodiments, when the lower locking projection 144 suitably passes through the restraining member 130, the cushion member 160 is suitably restored to its original state by the removal of the pushing force, and the restraining member 130 comes in contact with the lower support rib 143.

Accordingly, the cushion member 160 elastically pushes the restraining member 130 toward the lower support rib 143.

Preferably, the cover 150, which is slidably inserted into the guide groove 151, should not be accidentally disconnected therefrom.

In certain exemplary embodiments, an insertion projection 152 is suitably formed on the cover 150, and an insertion hole 154 for accommodating the insertion projection 152 is suitably formed on the fixed structure, i.e., the female housing 20.

Accordingly, as the insertion projection 152 is suitably accommodated in the insertion hole 154 in a state where the cover 150 completely covers the mounting hole 110, the cover 150 is not freely opened.

Preferably, the insertion projection 152 may have various shapes, and the position where the insertion projection 152 is suitably formed is not limited.

Preferably, although the insertion hole 154 is shown as a hole shape for convenience's sake, it may have a groove shape.

In further preferred embodiments, the locker 140 may be detachably fixed to the circumferential surface of the male housing 10.

In certain exemplary embodiments, guide ribs 172 facing each other are suitably formed on the circumferential surface of the male housing 10 in the axial direction, locking grooves 174 are suitably concavely formed in the inside of the guide ribs 172 facing each other, and locking projections 176 are suitably formed on the lower support ribs 143 to be elastically accommodated in the corresponding locking grooves 174.

Preferably, the lower support ribs 143 are suitably configured to extend from the body 141 and to be elastically bent and include the locking projections 176 formed on the outside thereof.

Preferably, the male housing 10 includes the guide ribs 172 having the locking grooves 174.

Accordingly, as the locking projections 176 are elastically inserted into the locking grooves 174, the locker 140 is elastically connected to the male housing 10.

According to further preferred embodiments, although the locking groove 174 is shown as a groove shape for convenience's sake, it may have a hole shape.

In other preferred embodiments, the locker 140 may be suitably connected to the male housing 10 in an accurate position.

For example, a position fixing groove 182 is suitably concavely formed on the body 141, and a position fixing projection 184 is suitably formed on the male housing 10 in the axial direction to be accommodated in the position fixing groove 182.

Preferably, as the position fixing groove 182 of the body 141 is slidably moved along the position fixing projection 184 of the male housing 10, the locker 140 can be suitably assembled with the male housing 10 in an accurate position.

Accordingly, the position fixing groove 182 may have various shapes and, although in certain embodiments of the present invention, the position fixing projection 184 may be suitably configured to be detached from the male housing 10, it is preferable that it is suitably integrally molded with the male housing 10.

Figure 8:
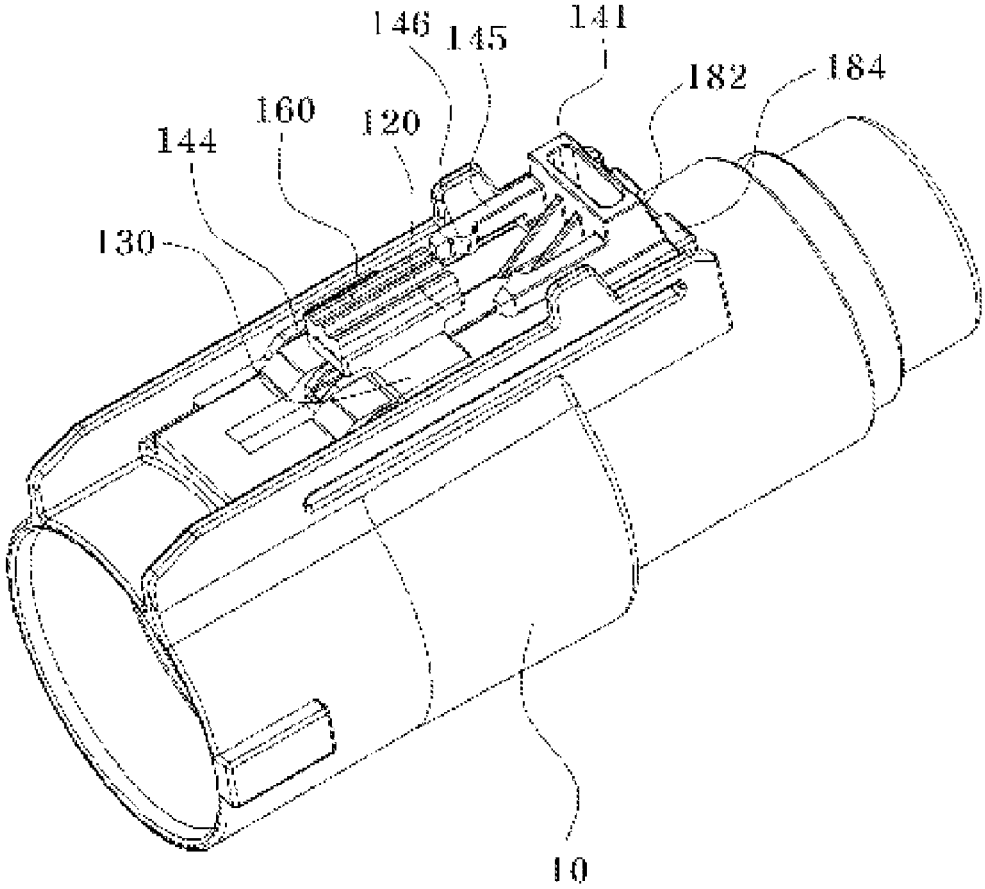
Figure 9:
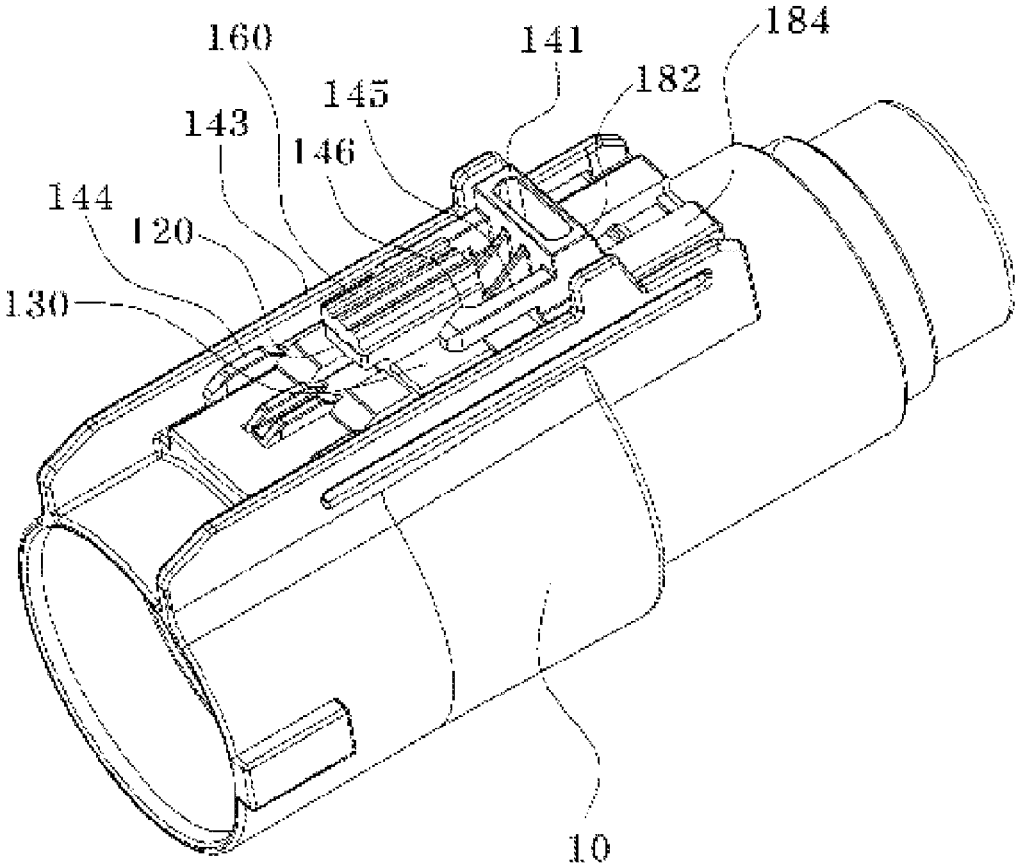

According to certain exemplary embodiments of the present invention, FIGS. 8 to 10 show how the male housing 10 is suitably inserted into the female housing 20 and suitably locked by the locking device 100.

Accordingly, when the male housing 10 is suitably inserted into the inside of the female housing 20, the lower locking projection 144 suitably formed on the lower support rib 143 of the locker 140 raises the restraining member 130, and thereby the restraining member 130 and the support member 120 are raised while compressing the cushion member 160.

Preferably, when the lower locking projection 144 suitably passes through the bottom of the restraining member 130, the upper support rib 145 is opened a predetermined amount by the upper locking projection 146 being in contact with the support member 120.

Preferably, simultaneously, as the cushion member 160 is elastically restored, the restraining member 130 is in elastic contact with the top of the lower support rib 143.

In further preferred embodiments, when the upper locking projection 146 passes through the support member 120, the upper support rib 145 is elastically restored to come in contact with the side of the support member 120 and the upper surface of the restraining member 130.

Accordingly, in further preferred embodiments, the support member 120 and the restraining member 130 are suitably elastically supported by the lower support rib 143 and the upper support rib 145 and fixed in the inside of the mounting hole 110.

Preferably, as the lower locking projection 144 of the lower support rib 143 is suitably locked by the restraining member 130 and, at the same time, the upper locking projection 146 of the upper support rib 145 is suitably locked by the support member 120, the locker 140 is firmly locked to the male housing 10.

As a result, the male housing 10 is suitably connected to the female housing 20.

As described herein, according to the locking device and the high voltage shield connector having the same of the present invention, since the restraining member capable of being lifted up and down in a normal direction is preferably provided on the female housing and the locker is preferably provided in a male housing, it is possible to suitably maintain the connection between the male and female housings even when the connector is frequently assembled and disassembled.

Moreover, as described herein, since the damping member having a coil spring shape is suitably provided between the fixing member fixing the female housing and the female housing, it is possible to suitably improve damping force when an external force in the axial direction is generated.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A locking device comprising:

a mounting hole configured to penetrate a fixed structure;

a support member configured to be supported on an edge of the mounting hole;

a restraining member extending to a lower portion of the support member and projecting to the inside of the fixed structure; and a locker restraining the restraining member and connected to the fixed structure, wherein the locker comprises:

a body being in contact with an edge of the fixed structure;

a lower support rib extending from the body and elastically supporting a lower portion of the restraining member; and an upper support rib extending from the body to be spaced apart from the lower support rib by the thickness of the restraining member, elastically supporting an upper portion of the restraining member, and elastically supporting a side of the support member.

2. The locking device of claim 1, wherein the lower support rib comprises a lower locking projection formed to project toward the upper support rib to prevent accidental disconnection in a direction opposite to the insertion direction into the fixed structure.

3. The locking device of claim 1, wherein the upper support rib comprises an upper locking projection locked by the support member to prevent accidental disconnection in a direction opposite to the insertion direction into the fixed structure.

4. The locking device of claim 2, wherein the mounting hole is opened and closed by a cover, which is slidably guided on the circumferential surface of the fixed structure, to prevent the support member from being separated outward from the mounting hole.

5. The locking device of claim 4, wherein between the lower support rib and the cover a cushion member is interposed such that the restraining member is maintained in contact with the lower support rib.

6. The locking device of claim 4, wherein the fixed structure comprises a guide groove and the cover comprises a guide projection which is accommodated in the guide groove.

7. The locking device of claim 4, wherein the cover comprises an insertion projection and the fixed structure comprises an insertion hole which accommodates the insertion projection in a state where the mounting hole is completely closed.

8. A high voltage shield connector comprising:

a male housing;

a female housing configured such that a portion of the male housing is axially inserted into the front thereof;

a fixing member partially axially inserted into the rear of the female housing and supporting the connection of the female housing;

a damping member interposed between the female housing and the fixing member to absorb an impact applied to the female housing; and a locking device for connecting the male housing and the female housing, wherein the fixing member comprises:

a plate member configured to be in contact with the female housing; and a sleeve member extending from the plate member and axially inserted into the female housing, wherein the damping member having a coil spring shape is provided on the circumferential surface of the sleeve member such that both ends of the damping member are supported to the female housing and the plate member.

9. The high voltage shield connector of claim 8, wherein the locking device comprises:

a mounting hole configured to penetrate the circumferential surface of the female housing;

a support member configured to be supported on an edge of the mounting hole;

a restraining member extending to a lower portion of the support member and projecting to the inside of the female housing; and a locker formed on the male housing to restrain the restraining member to be connected to the female housing.

10. The high voltage shield connector of claim 9, wherein the locker comprises:

a body configured to project from the circumferential surface of the male housing and to be in contact with an edge of the female housing;

a lower support rib extending from the body and elastically supporting a lower portion of the restraining member; and an upper support rib extending from the body to be spaced apart from the lower support rib by the thickness of the restraining member, elastically supporting an upper portion of the restraining member, and elastically supporting a side of the support member.

11. The high voltage shield connector of claim 10, wherein the mounting hole is opened and closed by a cover, which is slidably guided on the circumferential surface of the female housing, to prevent the support member from being separated outward from the mounting hole, and the cover includes a cushion member at the bottom thereof such that the restraining member is maintained in contact with the lower support rib.

12. The high voltage shield connector of claim 9, wherein the male housing comprises guide ribs configured to face each other and to project from the circumferential surface of the male housing in the axial direction, the guide ribs comprise locking grooves concavely formed in the inside of the guide ribs facing each other, and the lower support ribs comprise locking projections elastically accommodated in the corresponding locking grooves.

13. The high voltage shield connector of claim 12, wherein the body comprises a position fixing groove and the male housing comprises a position fixing projection formed in the axial direction to be accommodated in the position fixing groove.

14. A high voltage shield connector comprising:

a male housing;

a female housing configured such that a portion of the male housing is axially inserted into the front thereof;

a fixing member partially axially inserted into the rear of the female housing and supporting the connection of the female housing;

a damping member interposed between the female housing and the fixing member to absorb an impact applied to the female housing; and a locking device for connecting the male housing and the female housing, wherein the locking device comprises:

a mounting hole configured to penetrate the circumferential surface of the female housing;

a support member configured to be supported on an edge of the mounting hole;

a restraining member extending to a lower portion of the support member and projecting to the inside of the female housing; and a locker formed on the male housing to restrain the restraining member to be connected to the female housing, wherein the locker comprises:

a body configured to project from the circumferential surface of the male housing and to be in contact with an edge of the female housing;

a lower support rib extending from the body and elastically supporting a lower portion of the restraining member; and an upper support rib extending from the body to be spaced apart from the lower support rib by the thickness of the restraining member, elastically supporting an upper portion of the restraining member, and elastically supporting a side of the support member.

15. The high voltage shield connector of claim 14 wherein the mounting hole is opened and closed by a cover, which is slidably guided on the circumferential surface of the female housing, to prevent the support member from being separated outward from the mounting hole, and the cover includes a cushion member at the bottom thereof such that the restraining member is maintained in contact with the lower support rib.

16. The high voltage shield connector of claim 14 wherein the male housing comprises guide ribs configured to face each other and to project from the circumferential surface of the male housing in the axial direction, the guide ribs comprise locking grooves concavely formed in the inside of the guide ribs facing each other, and the lower support ribs comprise locking projections elastically accommodated in the corresponding locking grooves.

17. The high voltage shield connector of claim 16 wherein the body comprises a position fixing groove and the male housing comprises a position fixing projection formed in the axial direction to be accommodated in the position fixing groove.

* * * * *